US007252193B1

(12) United States Patent
Lewis et al.

(10) Patent No.: US 7,252,193 B1
(45) **Date of Patent: *Aug. 7, 2007**

(54) STORAGE

(76) Inventors: John Gordon Lewis, 2333 Mosley St., Ste. A, Waynesboro, VA (US) 22980; Marlana Bean Lewis, 2333 Mosley St., Ste. A, Waynesboro, VA (US) 22980

( * ) Notice: Subject to any disclaimer, the term of this patent is extended or adjusted under 35 U.S.C. 154(b) by 306 days.

This patent is subject to a terminal disclaimer.

(21) Appl. No.: 10/839,150

(22) Filed: May 6, 2004

Related U.S. Application Data

(60) Provisional application No. 60/468,673, filed on May 7, 2003.

(51) Int. Cl.
*B65D 69/00* (2006.01)
*B65D 85/00* (2006.01)

(52) U.S. Cl. ..... 206/373; 206/225; 206/226; 242/159

(58) Field of Classification Search ..... 206/225, 206/226, 372, 373, 702, 389, 397, 398, 407, 206/361; 242/159; 439/501
See application file for complete search history.

(56) References Cited

U.S. PATENT DOCUMENTS

| | | | | | |
|---|---|---|---|---|---|
| D4,837 | S | * | 4/1871 | Bockee, Jr. | D9/532 |
| 2,566,650 | A | * | 9/1951 | Anderson | 211/65 |
| 2,943,732 | A | * | 7/1960 | Kovaleski et al. | 206/389 |
| 4,269,461 | A | | 5/1981 | Roach, Jr. | |
| 4,437,713 | A | | 3/1984 | Roach | |
| 4,765,472 | A | * | 8/1988 | Dent | 206/373 |
| 4,768,546 | A | | 9/1988 | Brusadin et al. | |
| 4,771,206 | A | | 9/1988 | Taylor | |
| 4,826,007 | A | * | 5/1989 | Skeie | 206/373 |
| 4,852,833 | A | * | 8/1989 | Lockwood | 248/110 |
| 4,917,323 | A | | 4/1990 | Wing | |
| 4,984,685 | A | | 1/1991 | Douglas | |
| 5,103,977 | A | * | 4/1992 | Douglas | 206/702 |
| 5,142,457 | A | | 8/1992 | Wehner | |
| 5,183,280 | A | * | 2/1993 | Gresch | 280/79.5 |
| D339,976 | S | | 10/1993 | Ferguson, Sr. | |
| 5,287,965 | A | | 2/1994 | Miller | |
| 5,320,248 | A | * | 6/1994 | Jamieson, III | 220/669 |
| 5,429,265 | A | * | 7/1995 | Maire et al. | 220/522 |
| 5,437,369 | A | * | 8/1995 | Spitere | 206/373 |
| 5,447,318 | A | | 9/1995 | Gantz et al. | |
| 5,449,067 | A | * | 9/1995 | Cannon | 206/702 |
| D376,453 | S | * | 12/1996 | Park | D32/53 |
| 5,641,075 | A | | 6/1997 | Mechlin | |
| 5,642,898 | A | | 7/1997 | Wise | |
| 5,653,339 | A | | 8/1997 | Dobson | |
| 5,661,953 | A | | 9/1997 | Jolley | |
| 5,676,250 | A | | 10/1997 | Walters | |
| 5,794,649 | A | | 8/1998 | Spear et al. | |

(Continued)

*Primary Examiner*—Mickey Yu
*Assistant Examiner*—J. Gregory Pickett
(74) *Attorney, Agent, or Firm*—Donald Grant Kelly

(57) ABSTRACT

Portable container apparatus and method for co-storing work articles including working implements and their associated elongated elements such as cable, power cord, hose, wire, string, thread, yarn, rope, bridle or leash elements. The container retains a collection of working implements within its inner cavity while simultaneously retaining elongated elements upon its outer surface of revolution. The container rotates to facilitate wrapping and unwrapping of the elongated elements. The container, which may include retractable wheels, is further configured as a seat or step-stool. An optional electrical supply source is included on the container wall.

22 Claims, 14 Drawing Sheets

U.S. PATENT DOCUMENTS

| | | | | |
|---|---|---|---|---|
| 5,816,407 | A | 10/1998 | Daratony | |
| 5,833,095 | A * | 11/1998 | Russell et al. | 224/576 |
| 5,833,250 | A | 11/1998 | Schier et al. | |
| 5,868,334 | A | 2/1999 | Cedillo | |
| 5,876,047 | A | 3/1999 | Dennis | |
| 5,915,641 | A * | 6/1999 | Barberg | 242/395.1 |
| 5,941,388 | A | 8/1999 | Spielberger | |
| 5,988,384 | A | 11/1999 | Stoner et al. | |
| 5,992,627 | A | 11/1999 | Lai | |
| D417,538 | S | 12/1999 | Tisbo et al. | |
| 6,050,291 | A | 4/2000 | Whitehead et al. | |
| 6,053,322 | A | 4/2000 | Kim et al. | |
| 6,056,226 | A | 5/2000 | Green | |
| 6,079,720 | A | 6/2000 | Spear et al. | |
| 6,116,682 | A | 9/2000 | Baur | |
| 6,176,545 | B1 | 1/2001 | Hambleton | |
| 6,193,080 | B1 | 2/2001 | Castillo | |
| 6,254,055 | B1 * | 7/2001 | Lamberson, Jr. | 248/538 |
| 6,264,216 | B1 | 7/2001 | Wilson | |
| 6,315,310 | B1 * | 11/2001 | Hurt | 280/79.5 |
| 6,467,623 | B1 | 10/2002 | Lewis et al. | |
| 6,520,513 | B2 | 2/2003 | Presley-Mays | |
| 6,557,792 | B1 | 5/2003 | Snow | |
| D479,028 | S | 8/2003 | Moon et al. | |
| 2004/0226841 | A1 * | 11/2004 | Ginder, Jr. | 206/349 |

* cited by examiner

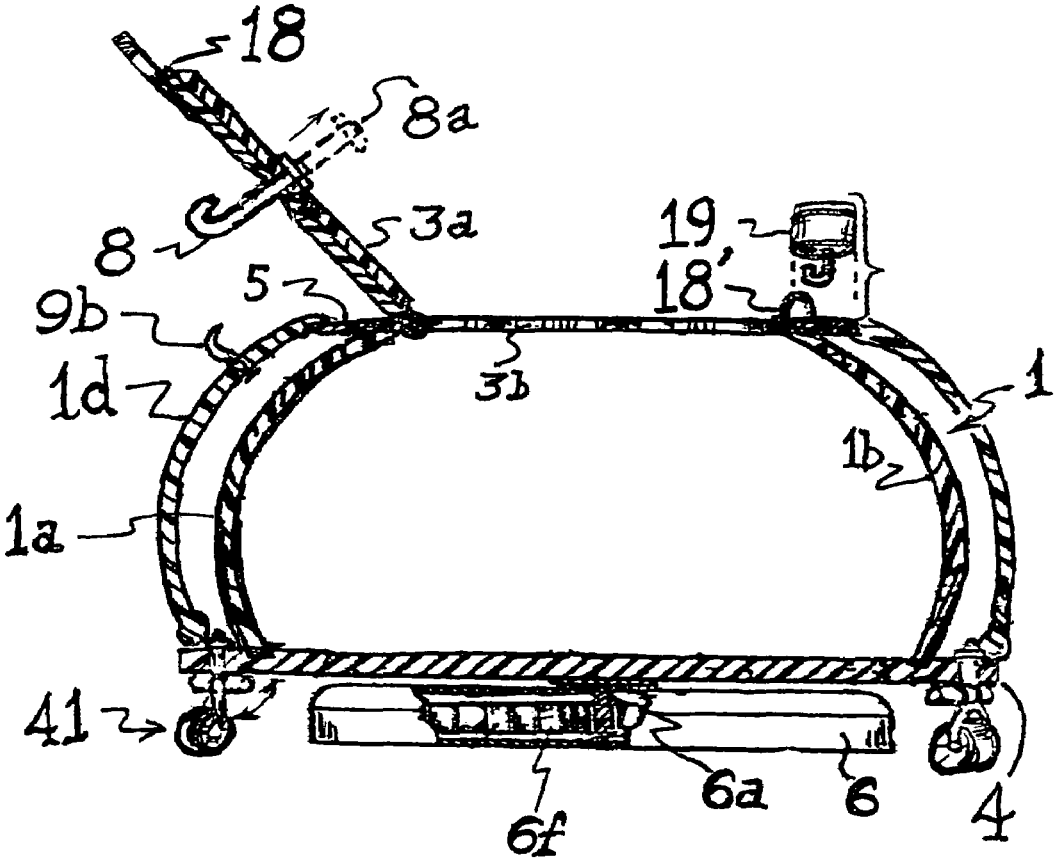
Fig. 7-A

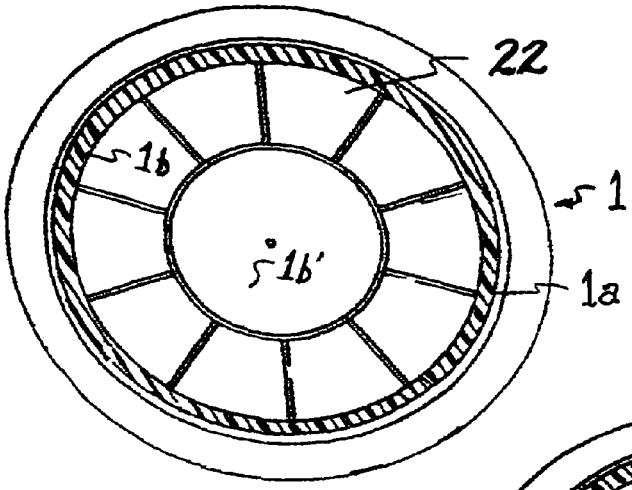
Fig. 9
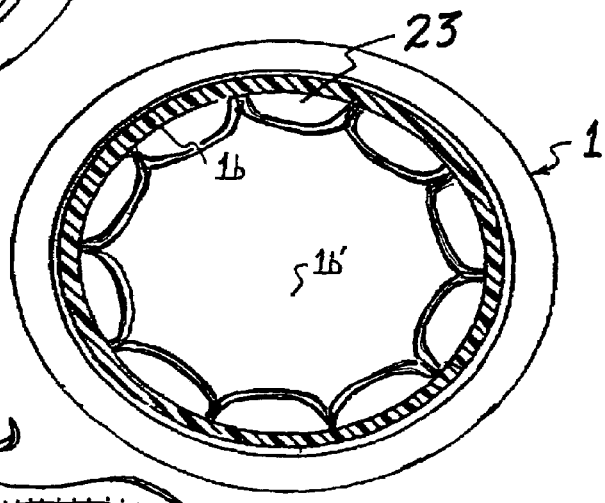
Fig. 10
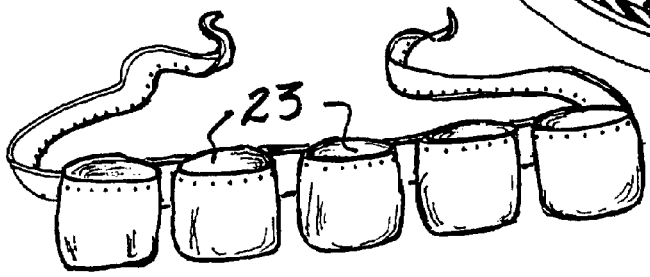
Fig. 10-A

STORAGE

REFERENCE TO RELATED APPLICATIONS

This application claims priority from U.S. Provisional Application Ser. No. 60/468,673, filed May 7, 2003. The present application also relates to application Ser. No. 09/865,131, and now U.S. Pat. No. 6,467,623, issued on Oct. 22, 2002, having the same applicants as the present invention, and wholly incorporated herein by reference.

STATEMENT REGARDING FEDERALLY SPONSORED RESEARCH OR DEVELOPMENT

Not applicable

REFERENCE TO SEQUENCE LISTING

Not applicable

BACKGROUND OF THE INVENTION

The present invention generally relates to the article storage field, including portable containers or holders and the method of their use. More specifically, the invention described herein relates to technology for temporary storage, transport, and convenient retrieval of articles for on-site work or hobby application.

Temporarily stored and transported articles, for example, might include implements such as hand tools, power tools, elements and related items. Such articles may further include those of a considerably different configuration, for example, elongated accessory elements such as cable, hose, rope, wire, cord, yarn, and string elements and the like, any of which may well find need for application at a remote work or hobby site.

In a wide variety of vocations and avocations, activities of individuals often involve intermittent need for and use of special tools, implements, utensils, accessories and the like. When not in use, the tools, implements, and so on, must be stored in an organized manner so as to be portable and conveniently accessible. Specific tasks undertaken command specific kinds of tools. For example, while some commonality exists, special implements are employed by carpenters, plumbers, handypersons, tailors or seamstresses, gardeners, stable workers, groomers, and so on. These represent examples only and for simplicity their special tools are hereinafter referred to collectively as articles.

Such articles are called into use only periodically; then placed in temporary storage during indefinite periods of non-use. Storage methods and facilities for these articles of vocation and avocation must be such that they remain handy for ready access, yet unobtrusive and securely preserved. Beyond that, they should be collectively portable as necessary. When the articles to be stored are in varied shapes and sizes, particularly including elongated members of varied lengths as well as a collection of uniquely shaped implements, portable storage is not so easy.

Articles of the type referred to herein may be discrete hand-actuated or hand-held implements, with few or no moving parts. Or they may be complex power tools such as drills, power screw-drivers, electric scissors and sewing machine units. Additionally the articles will include associated elongate items or accessories such as power cords, strings, wires, cables, hoses, leashes, bridles, yarn, measuring tape and such. Examples of power cords would be the well-known drop light power line used occasionally by workers dealing with low-lighting conditions at their work site, as well as cords associated with power tools such as hand drills and saws.

Gardening hobbyists are known to frequently experience the need for temporarily storing work related articles such as soil-working implements, seed packets, shears, clipper, hand-rake or other small hand-manipulated or power-driven implements. At the same time, they may have need for a water hose with attached nozzle, or power cords for certain electrically driven devices. Storing all these items in a conveniently handy manner can be difficult. Sewing and knitting equipment and materials such as needles, yarn, thread spools, scissors and so on, represent yet another hobby-type of environment demanding temporary storage containers for articles such as implements and elongated strands. For the professional gardener or tailor, work article storage obviously poses a challenge of a much greater magnitude.

Carpenters and plumbers similarly require transportable storage of an assortment of tools including collections of threaded and non-threaded fasteners, wrench sets, hammers, measuring tape, pliers, power drills, level, chisels, stud locator, power screwdrivers, and so on. They also find the necessity of transporting power cables of various lengths, including the shorter cable directly associated with a power tool as well as lengthy extension cables needed to access remote power sources. Such articles must be in easy reach of the carpenter and plumber; they should be conveniently organized and easily transported in bulk to the site of intended use.

Transporting, as by cart, truck or automobile, a stored collection of work or hobby related articles of the nature referred to above can be difficult and cumbersome, particularly when the shapes of the articles involved range from discrete implements to complex power tools and elongated cords, hoses and so forth. Invariably, the locations where individuals must apply or utilize the stored items are remote from their typical short-term or long-term storage location. This is true even if the articles are placed or kept within a toolbox or within an automobile trunk, truck bed, wagon or wheelbarrow bed and so forth. Also, there is the risk of breakage, entanglement, or loss.

Even if stored directly adjacent to the site of use (for example) temporary storage in an attic, closet, basement, garage, or shed, the retrieval of the stored items for use or application is not easy. This is especially true if such items, particularly cords and other elongated articles, have been stored in a random manner, and crammed together, disorganized, unsecured or loosely collected. In such instances, the prospective user or worker is likely to discover needed items have become lost, misplaced, damaged, or entangled, due either to their disorganized storage or clumsy transit, or both. This can bring significantly added costs to the consumer and society in general, in terms of time, energy, efficiency and/or necessary re-work.

Carrying out specific tasks of the type mentioned above, for example those of the electrician, plumber, gardener, seamstress or carpenter frequently involves strenuous, back-straining, knee-bruising activities. More specifically, such activities may require a person's capability of reaching higher levels out of normal arm extension range. Other activities may necessitate positioning one's self on bended knee or in uncomfortable bending and squatting positions. When stretching or twisting to trim a tall garden plant, hang pictures, or to apply ornaments and decorative lights, there is always a danger of hurting one's self. The required turning from task to task during work activities often involves stretching and twisting the torso or spine and/or sliding and pivoting on the knees or tip-toes. This hastens exhaustion, risks damage to one's clothing, and poses obvious physical hazards.

Besides the need for organized containers and the comfort aspect just described, the worker and hobbyist commonly face the need for access to electrical power when carrying out tasks with power tools or small appliances. Too often, a work site is found to be remote from any convenient outlets, requiring that extension cords be carried along with all the other items which may prove necessary to completing a particular task at hand. Extension cords stretched from a remote site to a distant power source are frequently left to recline at ground-level, underfoot and subject to damage and water hazard where interconnected to the cord of a hand tool. This, too, poses a physical hazard with serious implications for the user's health and safety.

Various apparatuses and methods have been proposed as solutions to these challenging problems of temporary item storage, preservation, safekeeping, organizing, ease of retrieval and ease of application or placement, power supply issues and user comfort and safety. There are a myriad of suggestions for tool boxes, re-useable decorating kits, sewing, crocheting, and knitting baskets, garden-caddies, free-standing or rotated power cord wrapping frames, hose reels, compartmented crates or storage containers.

Receptacles for storing articles such as tools and implements, and even elongated elements such as cords cables, strings, holiday lights, have been proposed in the prior art. For example, mobile and portable units or caddies designed to carry gardening implements are well known. Also well known are water hose storage containers adapted to retain the hose in a coiled state. Special compartmented boxes are known for the temporary storage of holiday lights and decorations, including posts around which light cords are wrapped. In another known storage container, the light strings are wrapped around frames suspended within a rectangular box.

It is apparent that the prior art in this field includes a wealth of ad hoc, special and general use containers and methods developed with good intentions of achieving or delivering convenient, organized and safe short-term storage of articles. Many are custom made to hold hand tools and related items. Still others are specially designed to accommodate elongated elements such as strings of decorative lights or power cords, or accommodate both the power tool and its associated power supply cord. These offer a variety of user advantages, even in some cases access to resources such as electricity.

Still, there exists considerable room for improvement in the form of a comprehensive method and apparatus affording handy, temporary co-storage, or simultaneous storage, of articles that include both working implements and task-associated elongated elements such as cable, cord, yarn, hose, leash, string, strap or strip elements, and so on. There also is considerable room for improvement in making such storage apparatuses and methods to be accommodating to the human user in a way that can be both safe and comfortable The shortcomings of the prior art, even in instances where only occasional access and application of stored items, as in the case of sewing tasks, seasonal gardening duties, plumbing emergencies, or decorating for holidays, bring great loss in efficiencies and frustration. Where hobbies are concerned, the lack of easy access to task-related articles, including both implements and associated elongated elements, can have discouraging results.

And, where more serious work is at hand, for example, involving professional electricians, carpenters, tailors, pet or animal groomers, and so on, the absence of easily usable apparatus and methods for co-storing work-related articles and elongated elements brings loss of effectiveness and efficiencies translating to economic costs to consumers and society as a whole.

Thus, it is the objective of the present inventive method and apparatus to address the above-noted shortcomings and present long-awaited improvements. The invention is fully and completely described as follows.

BRIEF SUMMARY OF THE INVENTION

This invention is directed to a method and apparatus providing for the co-storage, or simultaneous storage, of articles such as implements along with task-related, associated elements in the form of elongated members of varied lengths and purposes, such as power cord, light string, cable, hose, wire, yarn, string, leash, bridle, and similar elements.

A principal object of the invention is the provision and use of a storage container system where said container is designed with an outer surface side wall adapted for temporary storage of such elongated members, while the container includes a specially adapted interior for work-related articles. Essentially, said elongated members are wrapped around said outer surface in a manner that may require up to one or more loops.

Affixed to, or integral with, such outer surface are retention elements designed and strategically positioned to maintain a wrapped position of said elongated members. Said retention elements can include grooves or ridges which may be segmented or continuously annular or spiral in form. Alternatively, said retention elements may comprise strategically located buttons, nubs, lands, indentions, discrete ridge portions or other protuberances or recesses, or a combination of two or more such retention elements. These retention elements serve to keep a stored elongated member from sliding downwardly along the surface of said container, avoiding entangled, overlapped bunching around the container's lowermost area. Further, the outer surface may be treated so as to have a high coefficient of friction to further aid in the retention of said elongated elements.

It is a further object of this invention to facilitate retention of said elongated member in its stored, wrapped position along said outside surface, through the overall shape or configuration of said container outer wall area. Said container is shaped so as to have a larger horizontal cross-section at a lower portion or lower end surface thereof than at an upper portion or upper end surface thereof. In other words, the structural definition or configuration of said outside surface is such that it slopes outwardly from an upper member-wrapping region to a lower member-wrapping region. Stated in another way, the outer surface curves or slants upward and inward from adjacent the lower end surface to the upper end surface of the container.

Viewed in cross section, examples of container outer surface shapes or configurations that will resist a downward slide of elongated members wrapped or coiled therearound are: arcuate, conical, rhomboidal, pyramidal, sloped, parabolic. The annular surface of the container itself can be substantially a surface of revolution relative to a central axis of said container. By standard definition, a surface of revolution is a surface generated by rotating a two-dimensional curve around an axis. The resulting surface always has azimuthal symmetry. Examples of such surfaces include the apple, cone, conical frustum, cylinder, hyperboloid, lemon, oblate spheroid, paraboloid, prolate spheroid, pseudosphere, sphere, spheroid, and torus or toroid. While, as noted, the shape may be "substantially" a surface of revolution, other annular shapes of varying radii are considered equivalent thereto.

In every case, the annular circumference at the upper wrapping area of the surface is smaller than that at the lower wrapping area thereof, as noted hereabove. Said container has a construction that is substantially shell-like, meaning a substantially hollow cavity, and thus exhibits an inner surface essentially matching, conforming to, or mirroring the definitional shape or configuration of the container outer surface.

A still further object of this invention is to construct the interior of said container such that its inner surface defines a cavity with a bottom at the lower portion of said container adjacent to the lower surface thereof, and adapted to contain at least one or more articles, or a variety of articles, including but not limited to implements, elements, tools, accessories, ornaments, or similar items placed temporarily therein for short-term or long-term storage. As a way of organizing said articles in storage, said cavity and the surrounding container inner surface may be equipped with article holders. These holders may be pockets, slots and/or compartments. They may include one or more fixed, or temporarily connected, suspension members defining support hangers.

These article holders may be uniform or singular in character or type, or may be employed as combinations of two or more types, for example, a combination of hooks, slots and/or compartments. Said projections are designed to hold, secure, separate or contain one or several of said articles, including but not limited to the above discussed articles.

Yet another object of the instant invention method and apparatus is to construct the article holders described above such that they extend generally laterally from an inner wall surface of said container and into said cavity. Where the container inner wall is substantially a surface of revolution, the article holders can extend essentially inwardly, generally or substantially radially into said cavity. Regardless of wall configuration, however, said article holders may extend toward an imaginary center point of said container, or tangential to such point, or at random angles depending upon the nature of items to be attached or affixed thereto. Each suspension member connection at or near the inner wall may also be individually articulated or hinged so as to be adjustable in its angle of protrusion, and collapsible against the inner wall to provide open space.

To afford more efficient packing of stored items said suspension members or compartments can be staggered at varied heights across said inner surface. In other words, some hooks, hangers and compartments are stationed at differing heights measured from a lower or upper extremity of said cavity. Said compartments or pockets can be arranged circumferentially around the lower extremity or at/near the bottom of said internal cavity, and a central post, pocket or compartment can be provided therein to support a larger tool, implement, ornament or similar item.

It is a still further object of this invention to ensure confinement of a wrapped elongated member around said outer surface of the container, through the provision of lower and upper flanges. Said flanges may be removably affixed to said container outer wall, or may be formed integral therewith. The container includes an upper edge and a lower edge generally defining an upper and lower terminus of said container side wall. Said lower flange may be located and shaped so that it extends outwardly from or near said lower edge. Similarly, said upper flange may extend outwardly from or near said upper edge.

As another aspect of the invention, a separate hood structure, generally matching the configuration of said container outer surface yet of a size, volume, or circumference slightly greater than said outer surface, can be provided so as to protectively encompass said outer side wall and any elongated member wrapped therearound. In such case, said lower and upper flange offer support and define spacing for said hood. Additional projection members, such as hooks, loops, rods and the like, can be positioned on the outer surface of the hood for hanging, attaching or storing additional accessories or other items as may be desirable.

As a still further refinement, it is an object of this invention to provide the storage container with a base unit at or adjacent to a lower edge or end of said container. Said base unit includes a substantially vertical pivot substantially aligned with said container axis, upon which said container may be mounted for rotation, either hand driven, spring driven or motor driven.

Optionally, said vertical pivot can be affixed to either said container or said base. Thus, by rotating the container about said pivot, elongated members can be easily, and without tangling, drawn and wrapped for storage around the outer surface of the side wall. Similarly, by simply pulling on a free end of the elongated member, the elongated member can be unwrapped. Optionally, an electric motor can be drivingly associated with the base and container so as to selectively engage said container and base for powered rotation of the container, as desired, and in a manner to be described.

Another object is to provide a portable storage container that can, as needed, serves as a seat or step stool. The container upper surface adjacent the container's upper flange may be provided with a closure or lid support rim. The rim and upper flange may be either fully annular or segmented as long as they are sufficiently sturdy to support a user's weight. The lid or closure may be twisted into position or directly placed on the rim. Alternatively, it will be seen that the lid or closure may be provided with one or more conveniently placed hinges associated with, and operatively connected to, said support rim. When closed, said lid and support rim afford a work-seat, a step-stool, or standing platform from which a user can conveniently operate.

A locking mechanism may be affixed to said lid and said support rim to secure said closure or lid in position for safety and security. This mechanism may be selected from a variety of well known locking devices and methods such as hasp and padlock, key operated throw bolt, simple key latch, sliding bolt, combination lock, hook and eye, stick and loop, and so on. Still other ancillary features of the storage method and apparatus include power supply outlets or sockets located on the container wall to facilitate access to electricity for certain of the articles stored.

A further object is to provide said temporary storage container with a convenient hanging element by which the entire container may be suspended. The hanging element may take the form of a suspension wire or rod. Said wire or rod has a first end fastened, for example, by a bent portion or portions respectively inserted through a hole or holes at or near an upper area of said storage container, such that a bent portion supportively engages within said hole or holes. At a second end of said wire or rod may be provided an integral, or attached, curved hanging/carrying handle portion. Said suspension wire or rod is designed such that it can be depressed, recessed or retracted in its entirety into said housing when not needed.

Of course, any number of other, equivalent suspension designs will suffice. Straps of a flexible or inflexible nature can be utilized, as can a looped handle or bale. For example, said rod may be permanently or semi-permanently attached to said housing as by threaded fasteners, or could be a totally separate suspension device not structurally related directly to said housing, yet serving to cradle said housing where it is stored away.

Other objects, features, and characteristics of the present invention will become apparent upon consideration of the following full description, and the appended claims, and with reference to the accompanying drawings, wherein like reference numerals designate corresponding elements in the various figures.

BRIEF DESCRIPTION OF THE SEVERAL VIEWS OF THE DRAWINGS

Referring now to the accompanying drawings, constituting a part hereof, and where like reference characters indicating like parts, it is seen that:

FIG. 7-A is a similar section, but showing an alternative version including retractable rollers and lid lock;

FIG. 9 is a horizontal cross-section of the embodiment shown in FIG. 8, illustrating another view of the compartmented configuration;

FIG. 10 is a horizontal cross-section similar to that shown in FIG. 9, but illustrating multiple, flexible pockets used in lieu of, or in conjunction with the above described compartmented configuration; FIG. 10-A shows the flexible pockets of FIG. 10 withdrawn from the storage container interior;

DETAILED DESCRIPTION OF THE INVENTION

In FIGS. 1–16 are illustrated the method and apparatus for temporarily storing and transporting articles such as discrete tools, implements, utensils, ornaments, decorative accessories and the like along with their task-related elongated elements such as associated power cords, strings, wires, cables, hoses and the like, all as above-described. The article storage container, designated as 1, is illustrated herein as a shell-like or hollow, generally rounded construction, and adapted to temporarily store work implements therein as will be more thoroughly discussed below.

Also, the container has an outer surface 1*a* shaped and adapted to retain stored elongate elements wrapped around said outer surface. To help retain said wrapped elements, said outer surface 1*a* is provided at least one concentric annular ring 2. There can be several such rings or other surface irregularities such as ridges, grooves, or protuberances. Such protuberances may be nubs, ribs, buttons or segments. Outer wall 1*a* is further given a non-slip surface texture, indicated at 1*c*, to provide it with a high coefficient of friction. To further ensure retention of elongated elements, the shape of said outer surface, as discussed above, a surface of revolution which slopes upward and inward from adjacent the lower end surface to the upper end surface of the container. A movable lid or closure 3 acts to enclose said container at its upper end surface, and may be hinged at 3' or may be wholly removable as by lifting or turning.

Figure 1:
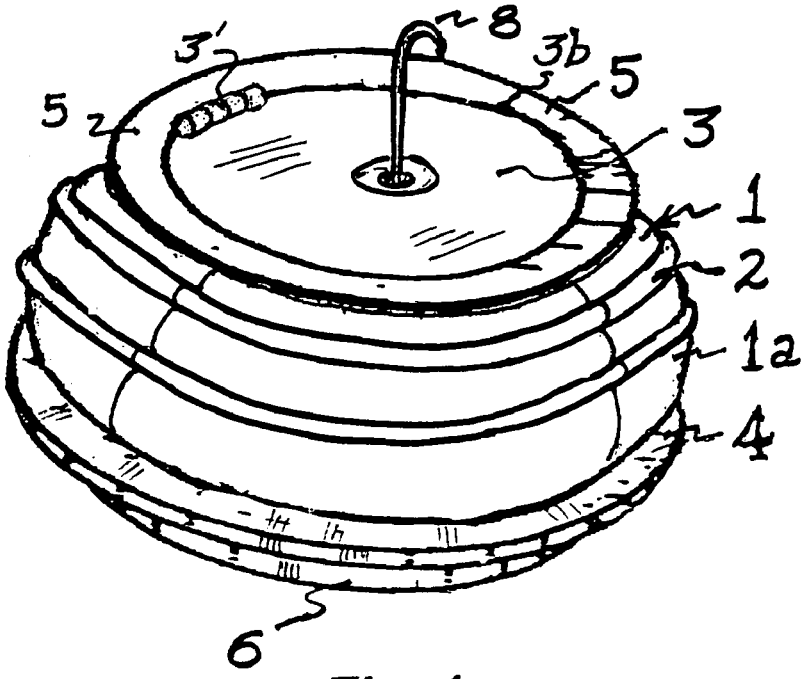
FIG. 1 shows a perspective view illustrating the general configuration of the container apparatus with its hanging element extended from the container.
Figure 2:
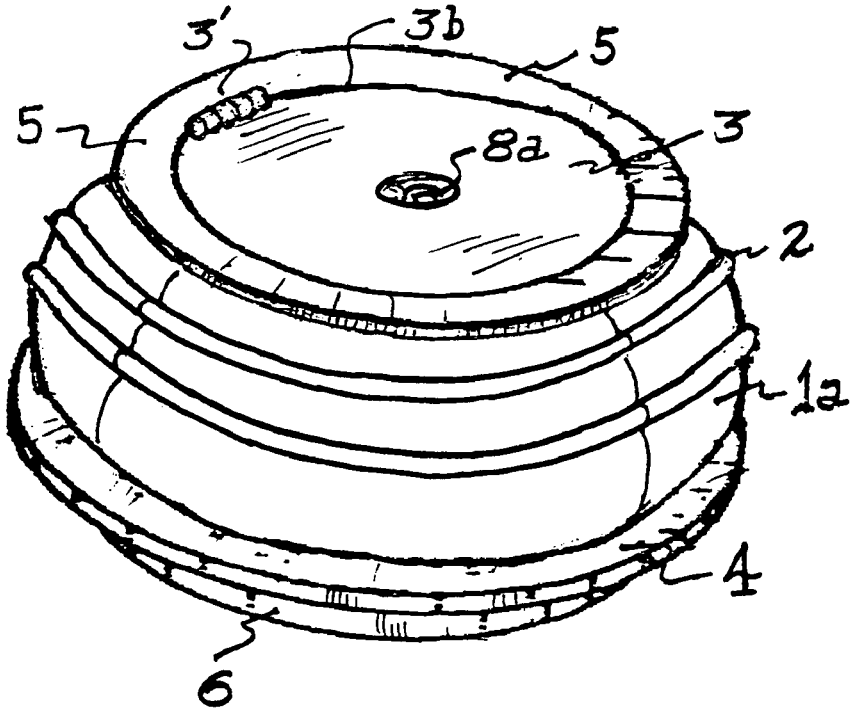
FIG. 2 shows a similar perspective view wherein said hanging element is retracted or depressed into the container.

A substantially flat lid is shown in FIGS. 1 and 2 as nesting or snuggly fitting into an opening 3*b* at or near an upper end of said container and movable from a fully closed to fully open position and vice versa. A suspension or hanging structure designated 8 is illustrated as retracted or depressed into housing lid 3 in FIG. 2, and extended outwardly in FIG. 1. Flanges 4 and 5 surround said outer surface 1*a*, and may be either attached thereto or integral therewith, as will be further described. These flanges define or confine the lower and upper extent of the outer wall 1*a* with its ribs, ridges, grooves or protuberances 2.

Figure 3:
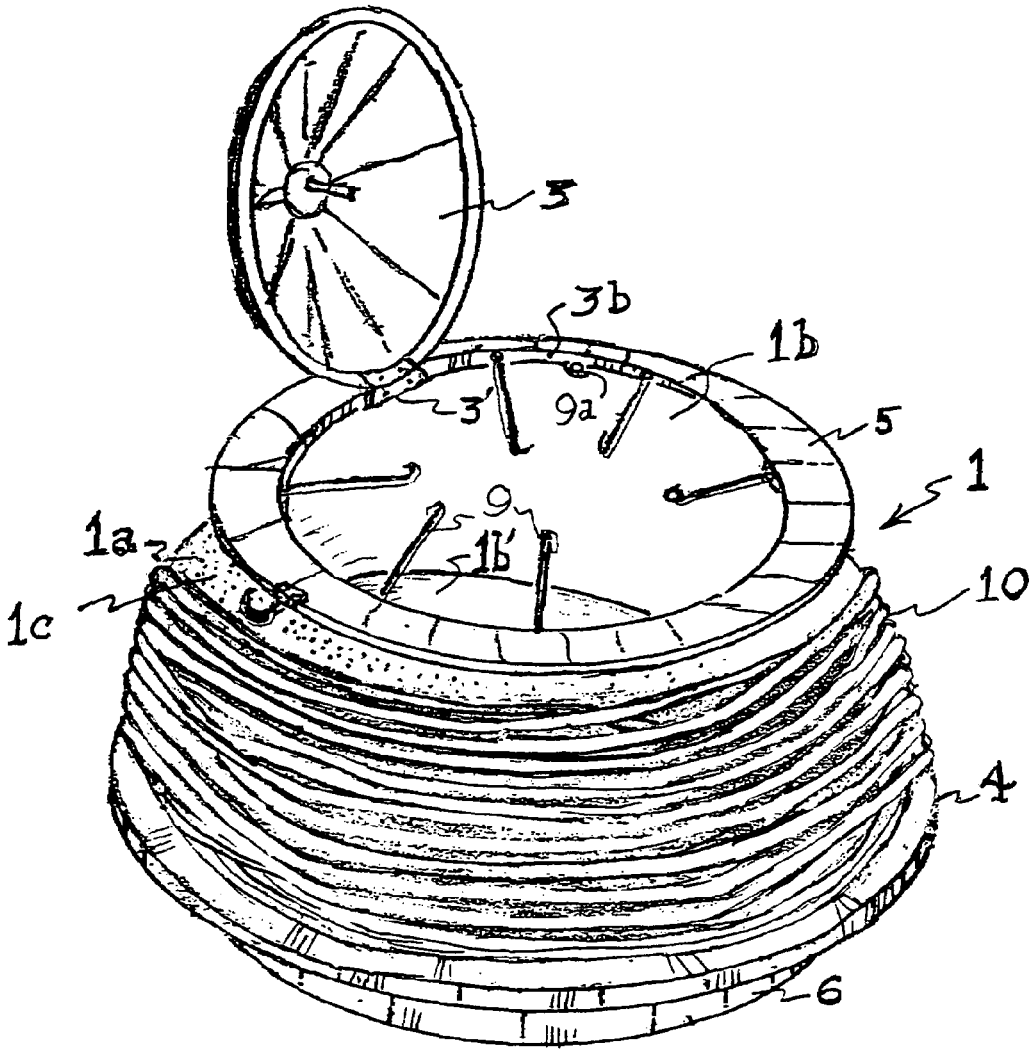
FIG. 3 is another view of the storage container in accordance with the apparatus and method, where an open lid reveals hooks or suspension members attached to an inner wall, and an elongated member wrapped around the container's outer surface.

In FIG. 3, suspension members 9, shown as fasteners or hangers, are seen as extending inwardly of the storage housing inner wall 1*b*, where they are inserted into inner wall hole or orifice 9*a*. Also shown in FIG. 3 is an elongated member being stored or wrapped upon and around said housing 1, engaging outer surface 1*a*. The member shown may be any of a variety of elongated, task-related elements to be utilized by the user, and may include wire, strap, cable, string, bridle, leash, rope, yarn or similar members as above discussed.

Figure 4:
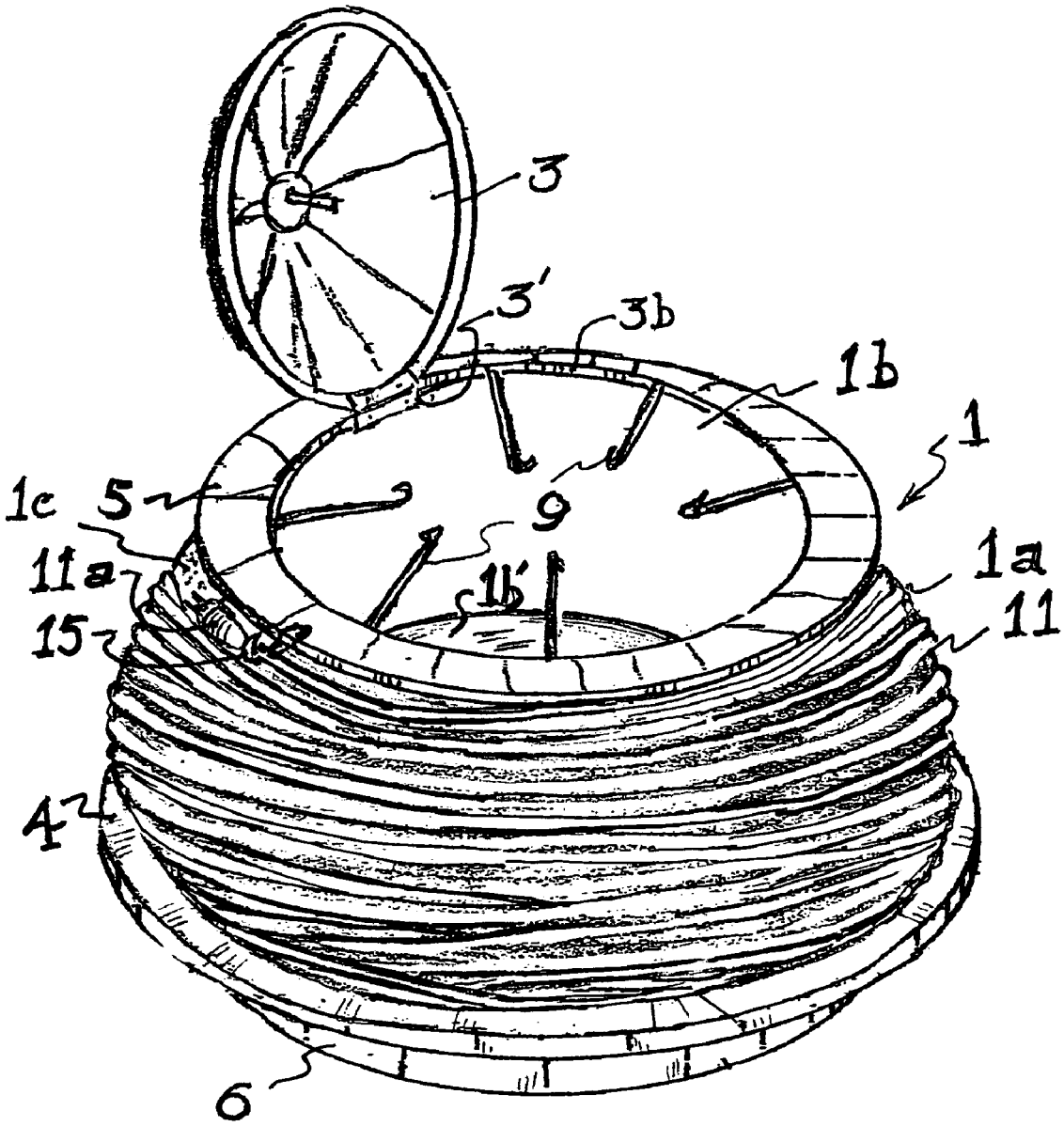
FIG. 4 illustrates a view similar to that shown in FIG. 3, wherein said elongated member is in the form of a power cable.

Illustrated in FIG. 4 is a wrapped and stored electrical cable 11, the male plug element 11*a* of which is shown fastened or temporarily restrained by hook 15 located at or near outer surface 1*a*, preferably on or near flange 5.

Figure 5:
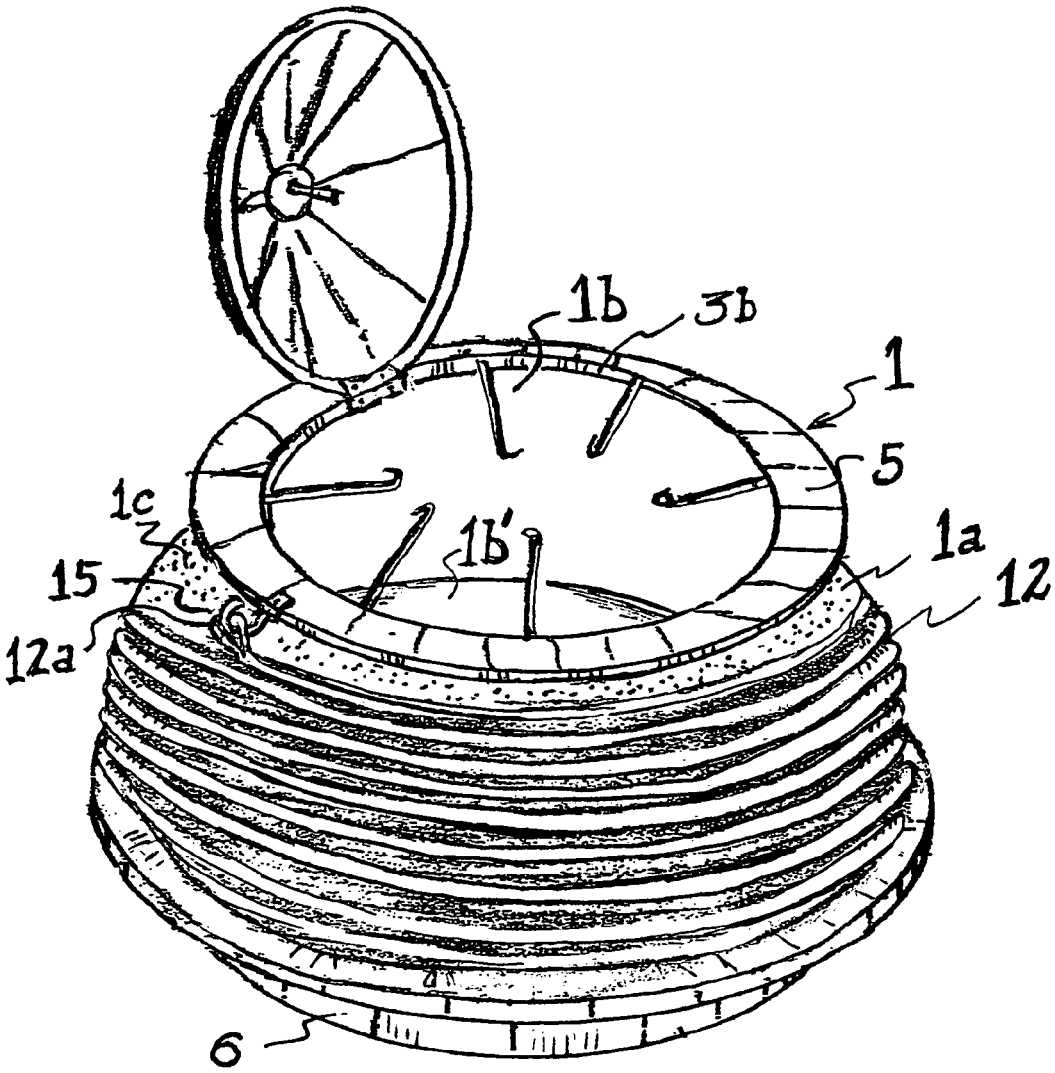
FIG. 5 shows an isometric view similar to that shown in FIG. 3, but where said elongated member has a loop engaged or fixed temporarily to an outer fastener element.

Similarly in FIG. 5, elongated member 12 in the form of a leash or rope is shown restrained by hook 15 in loop 12*a*.

Figure 6:
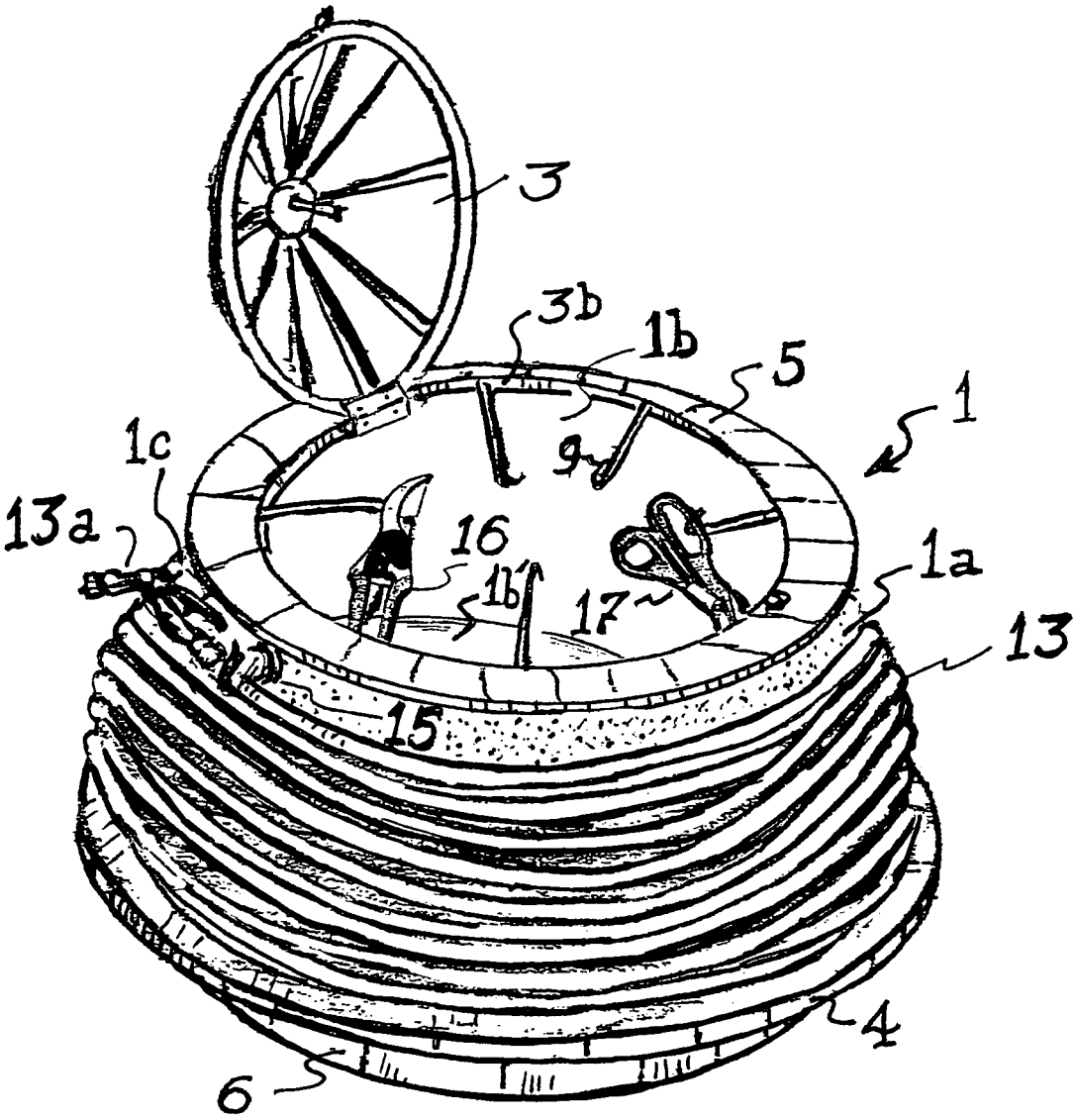
FIG. 6 illustrates, through an isometric view, the use of the apparatus as a temporary storage container for gardening tools and implements.

FIG. 6 illustrates a method and apparatus for temporarily storing and transporting gardening paraphernalia. In this adaptation, hose 13 is wrapped or coiled around housing outer surface 1*a* and restrained from movement by hook 15 at its nozzle end 13*a*. Other gardening implements and devices are illustrated as hand manipulated stem or twig trimmer 16 and clipper 17, located within said housing. These implements and hand tools are supported or secured by suspension members or hooks 9 extended inwardly from inner wall 1*b* within easy reach, along with such other gardening implements (not shown) as may be required.

Figure 7:
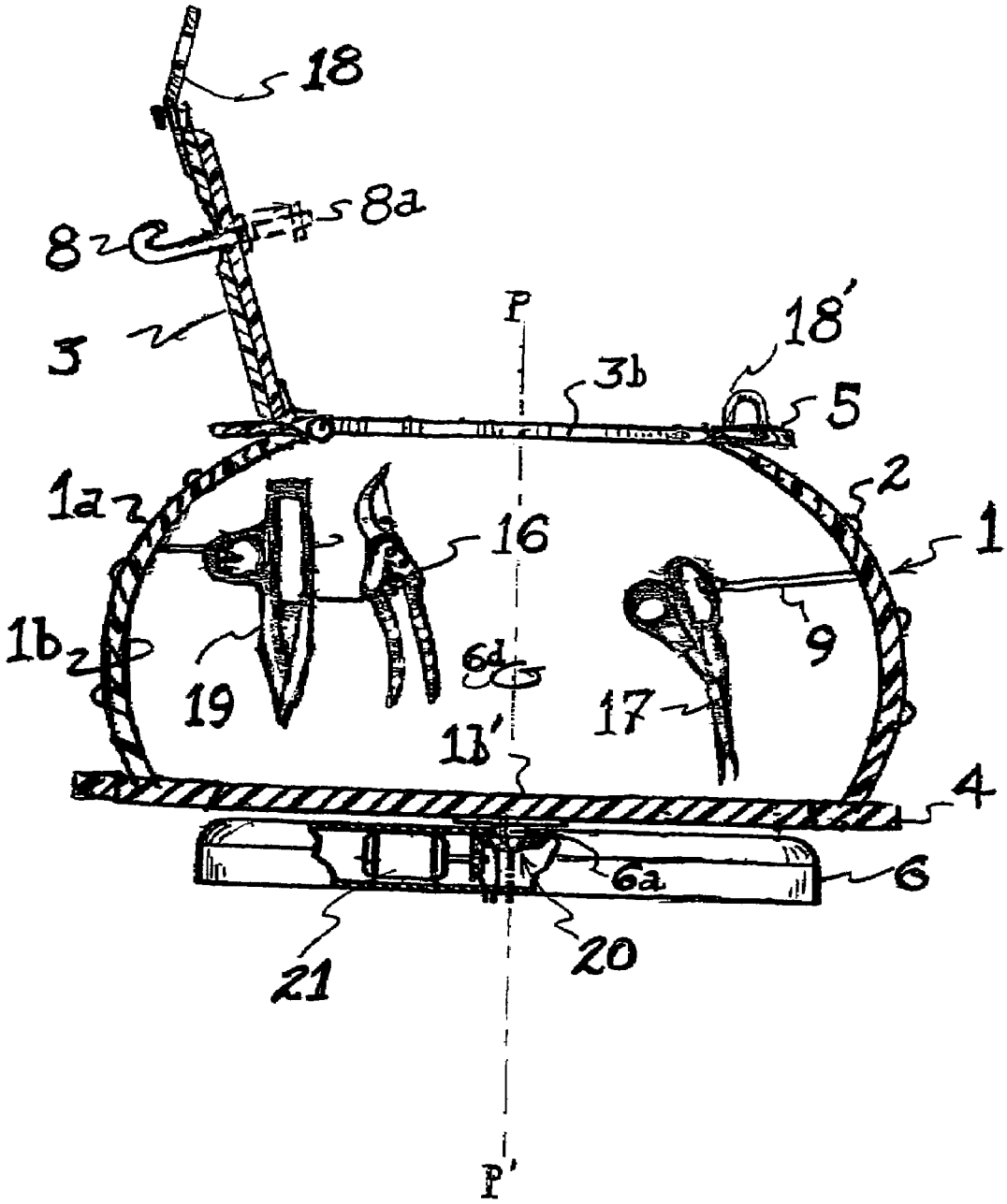
FIG. 7 is a vertical section of the apparatus illustrated in FIG. 6, but with parts cut away.

A vertical cross-section of the container apparatus is shown as FIG. 7 and FIG. 7-A, illustrating other tools such as implement 19 within said storage housing and located conveniently along housing inner wall surface 1*b*. Shown at the openly extended portion of lid 3*a* in FIG. 7 is an articulated hasp element 18. Note that support base 6 may be designed so as to include an electric motor 21 and associated bevel gear arrangement 20 that will provide a driving force for turning said housing 1 as will be further described below.

As viewed in FIG. 7-A, an optional lock configuration 19 is adapted to cooperate with hasp 18 and locking eye 18' to secure the lid 3*a* in a closed position. In this view is further illustrated how the housing bottom inner wall 1*b'* is associated with lower flange 4 and support base 6. Also illustrated in FIG. 7A is a hood member 1*d* adapted to be placed upon and around outer wall surface 1*a*, to hide and protect any stored, elongated elements wrapped therearound. Alternatively, one or more hooks 9*b* may be provided. Optional rollers or casters are shown at 41, to be selectively moved from an operative position to an inoperative position (shown in phantom), depending upon the need of the user.

The sectional view shown in FIG. 7 best illustrates the arcuate shape of outer and inner wall surface 1*a* and 1*b*, respectively. It is clear that the outer and inner surface are surfaces of revolution and each said surface extends upwardly and inwardly with respect to central pivot axis (and container central axis) P–P'. Container 1 is structured so as to define a top opening affording access to the internal cavity. Lid 3*a* is illustrated as a sturdy structure such that, when closed across the container opening, said lid cooperates with upper flange 5 to serve as a weight-bearing support surface. This support surface thus forms a convenient seat or step-stool for the user. Taken with the optional provision of rollers illustrated, as an example, in FIG. 7-A, this construct affords a uniquely convenient, all purpose portable storage apparatus.

Figure 8:
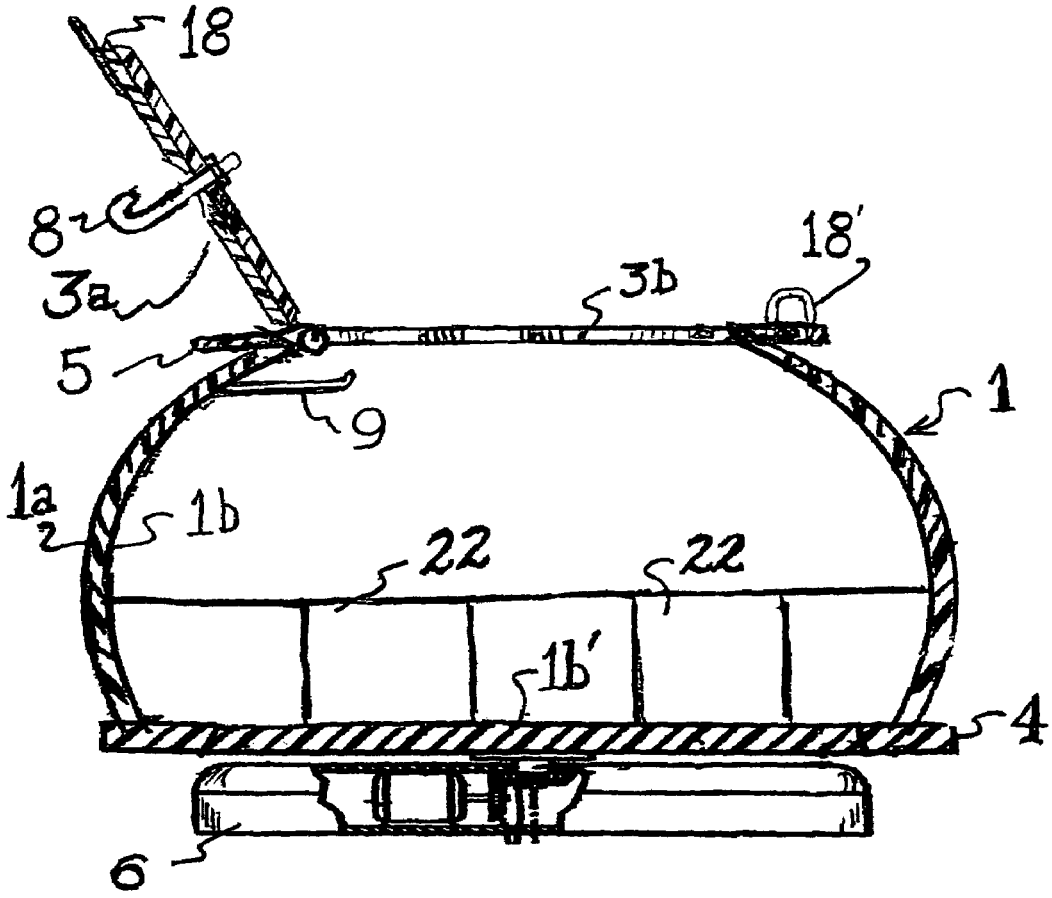
FIG. 8 illustrates yet another iteration of the apparatus in a vertical section with parts cut away, and particularly illustrating an inner compartmented configuration.

FIGS. 8 and 9 illustrate compartments 22 positioned within said housing 1 and associated with inner wall 1*b*. These compartments may be separate and removable, or integrally formed with inner wall 1*b* as desired. Lid or closure 3*a* is shown preferably as substantially flat, as compared to lids of other shapes as illustrated for example at 3 in FIG. 3. Hook 8 is shown extended, but may be retracted as shown in dashed lines at 8*a*.

In FIG. 10 are shown flexible pockets 23 arranged around an inner periphery of housing 1 to be utilized in lieu of, or in conjunction with, the more rigidly configured compartments 22 described above. These pockets can be made of natural or synthetic fabric material and may serve to confine any of a variety of articles such as implements, tools, fasteners, and so on. Conveniently, said pockets 23 may be serially connected with one another (for example, sewn along a belt or strip) and can readily be removed as a unit and used separately, or even worn around a user's torso as a work apron, as further illustrated in FIG. 10-A.

Figure 11:
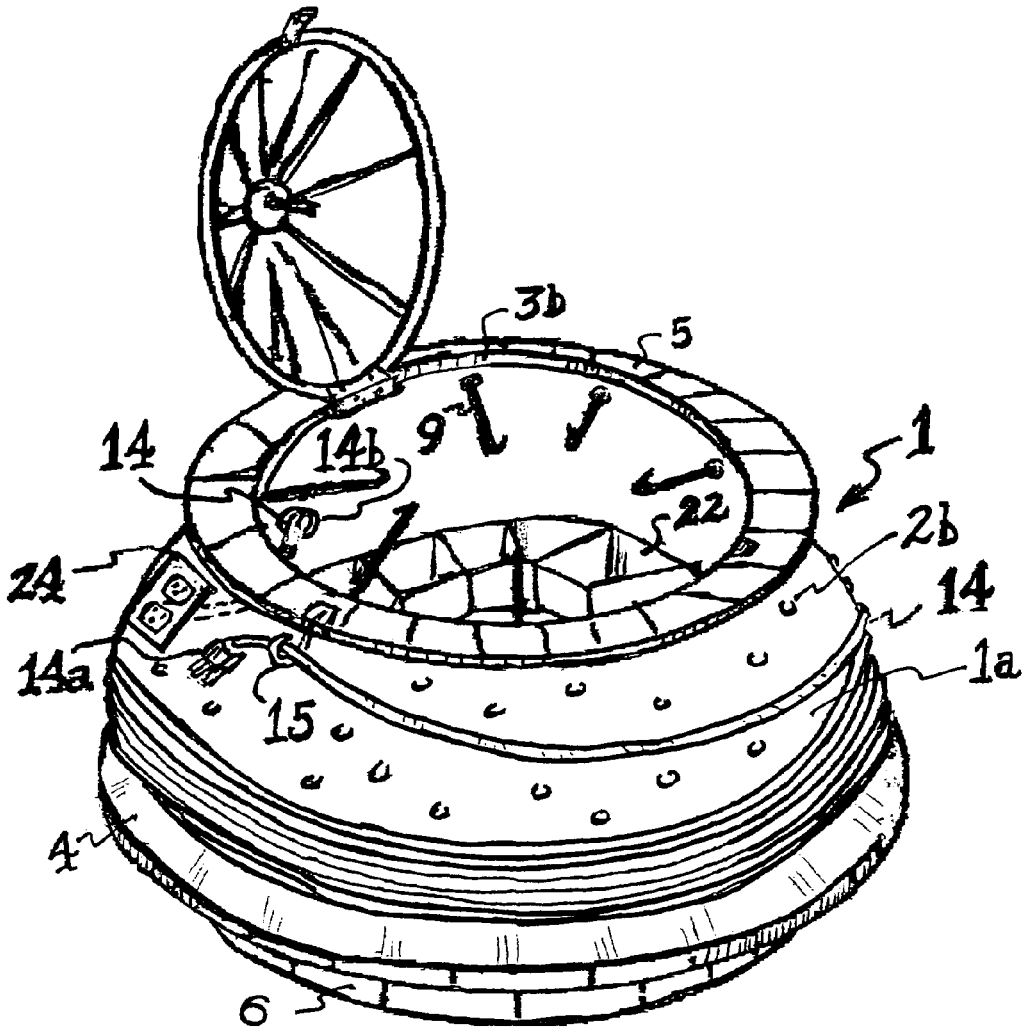
FIG. 11 illustrates an isometric view of an embodiment of the storage container wherein is provided an extension power cable along with a built-in electrical female-type connector accepting cord plugs for power-tool.
Figure 12:
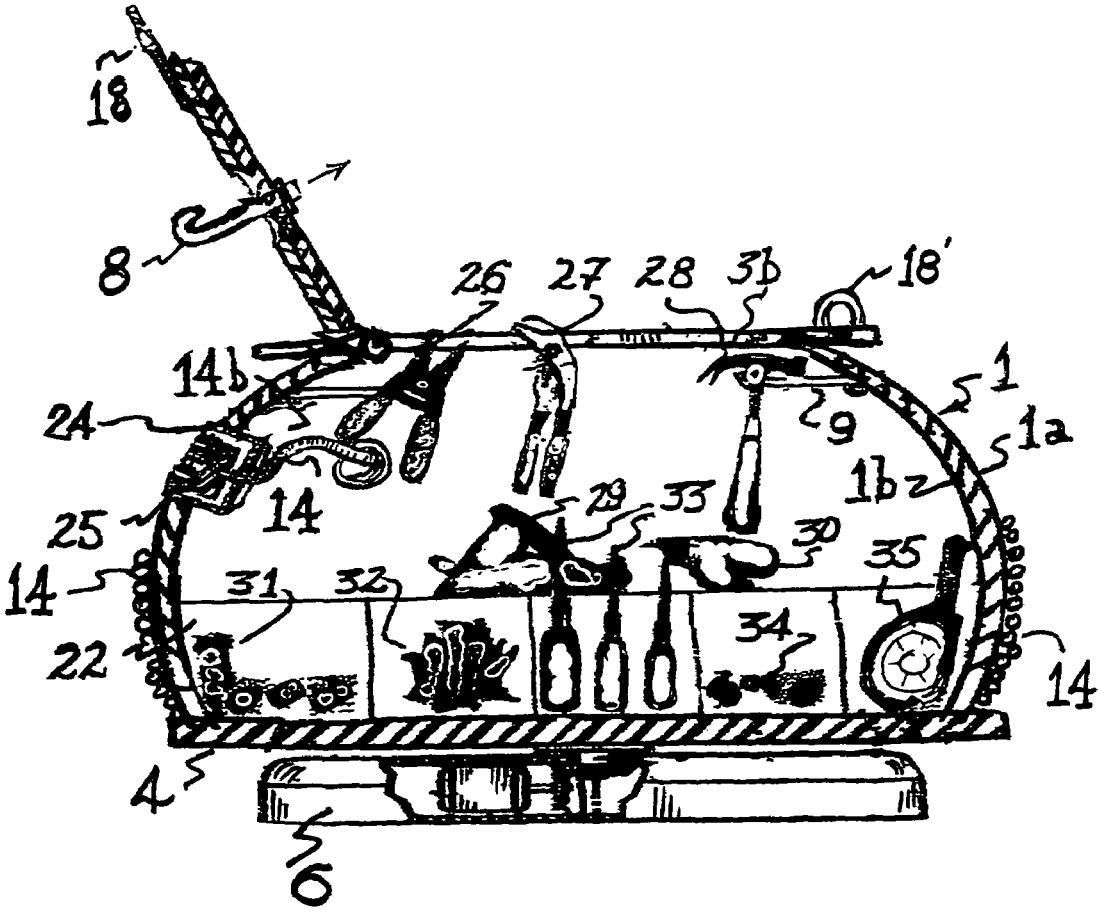
FIG. 12 is a vertical cross-section of the storage container of the type and configuration generally as shown in FIG. 11, but specifically adapted for carpentry work, and illustrating the juxtaposition of suspending members and compartments.

FIGS. 11 and 12 illustrate a further refined version of said method and apparatus for storing and transporting as above described. In this embodiment, an extension cord 14 is shown to be wrapped or stored around housing 1 at wall surface 1*a*. Note that surface 1*a* is shown in FIG. 11 to have surface nubs or irregularities 2*b* in order to provide a textured area to help retain cords or other elongated members stored on surface 1*a*. Note also that hook 15 located at or near the upper flange 5 holds or restrains the male plug end 14*a* of cord 14. As best viewed in FIG. 12, said cord 14 extends into said container housing 1 through hole or opening 14*b* located conveniently in wall surface 1*a*. Cord 14 then terminates within electric socket unit 24 fastened in an opening 25 conveniently located in housing 1 accessible at outer wall 1*a*.

Thus, the embodiment specifically illustrated in FIG. 12 represents the adaptation of the storage and transportation housing 1 to accommodate electrician's or carpenter's tools (or, of course, household tool collection for similar purposes). In this instance, the cord 14 serves as a bi-plug extension providing electricity in the housing wall for easy access by the user as will be further described below. For illustrative purposes, the illustration in FIG. 12 shows a variety of carpentry tools and implements held within the container housing 1. Specific utensils and implements are shown as wire cutter/crimping tool 26, wrench 27, hammer 28, saw 29, drill 30, threaded and miscellaneous fasteners 31, pointed fasteners 32, screwdrivers 33, clips 34 and retractable tape measure 35. All are organized on suspension members or hooks 9 or in compartments 22.

When necessary to utilize a power tool such as drill 30, the storage container unit is powered through a built-in power supply feature. By unwrapping said extension cord 14 and extending its male plug portion to an available yet remote female socket electricity supply of a suitable power rating, the support container housing is thus empowered at its own outlet box unit 24. The drill cable (not shown) may then be plugged into outlet box unit 24. Subsequently, said drill 30 may be stored and other power tools may be employed in a similar manner, such as saw 29 and so on. When finished, the electric motor under said housing may be used to retrieve and rewind said extension cord 14, self-wrapping it around the outer surface 1*a* of said container housing 1.

Figure 13:
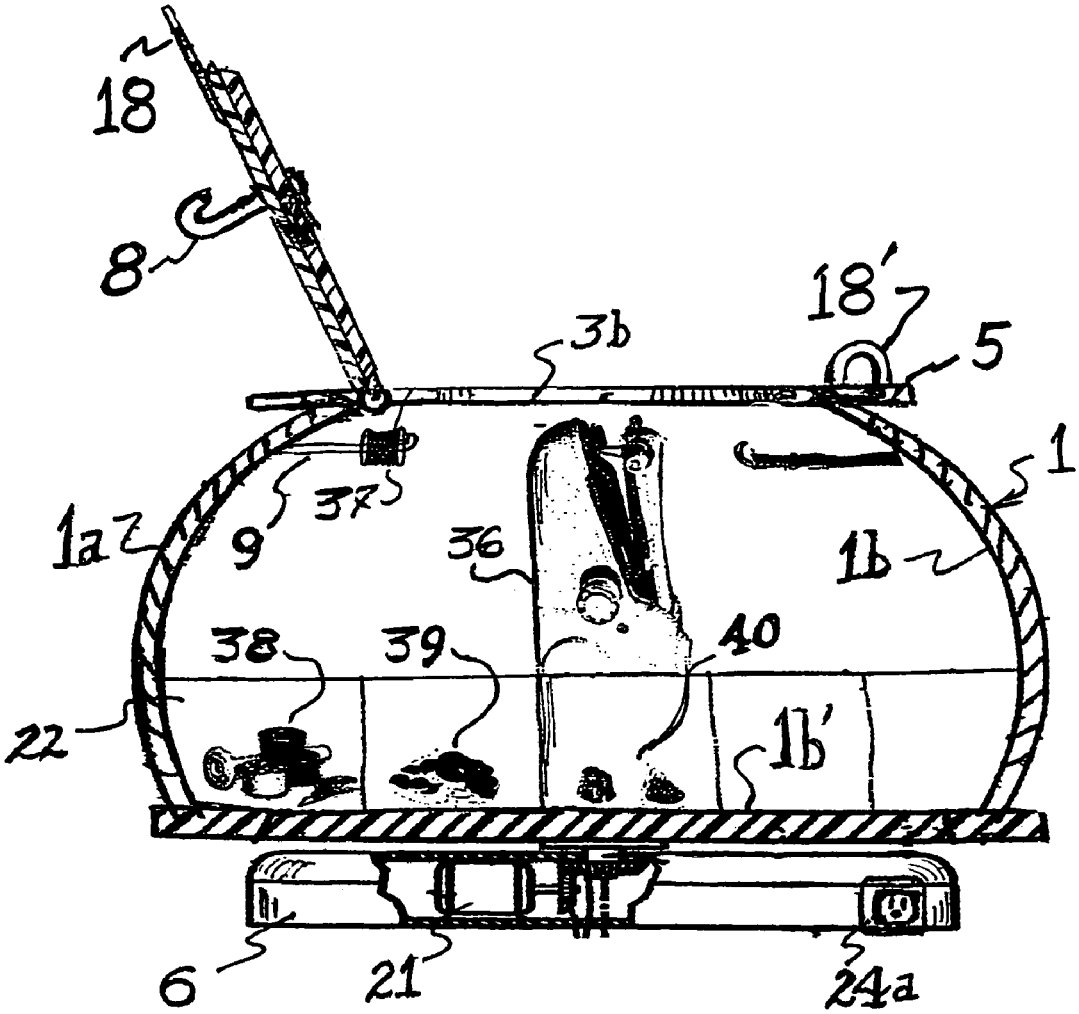
FIG. 13 shows another vertical cross-section of a storage container adapted for temporary storage of sewing equipment and materials.

Illustrated in FIG. 13 is an embodiment of storage and transporting housing 1 configured as a sewing kit. Included are thread spool 37 mounted on suspension member or hook 9, and other, associated sewing related materials and implements shown at 38, 39, and 40 conveniently and safely stored in compartments 22. Sewing unit 36 is shown in the center. This embodiment may of course be provided with the remote power extension cable 14 and socket unit 24, as illustrated above. Shown on base 6 is the alternative socket unit 24*a*.

Figure 14:
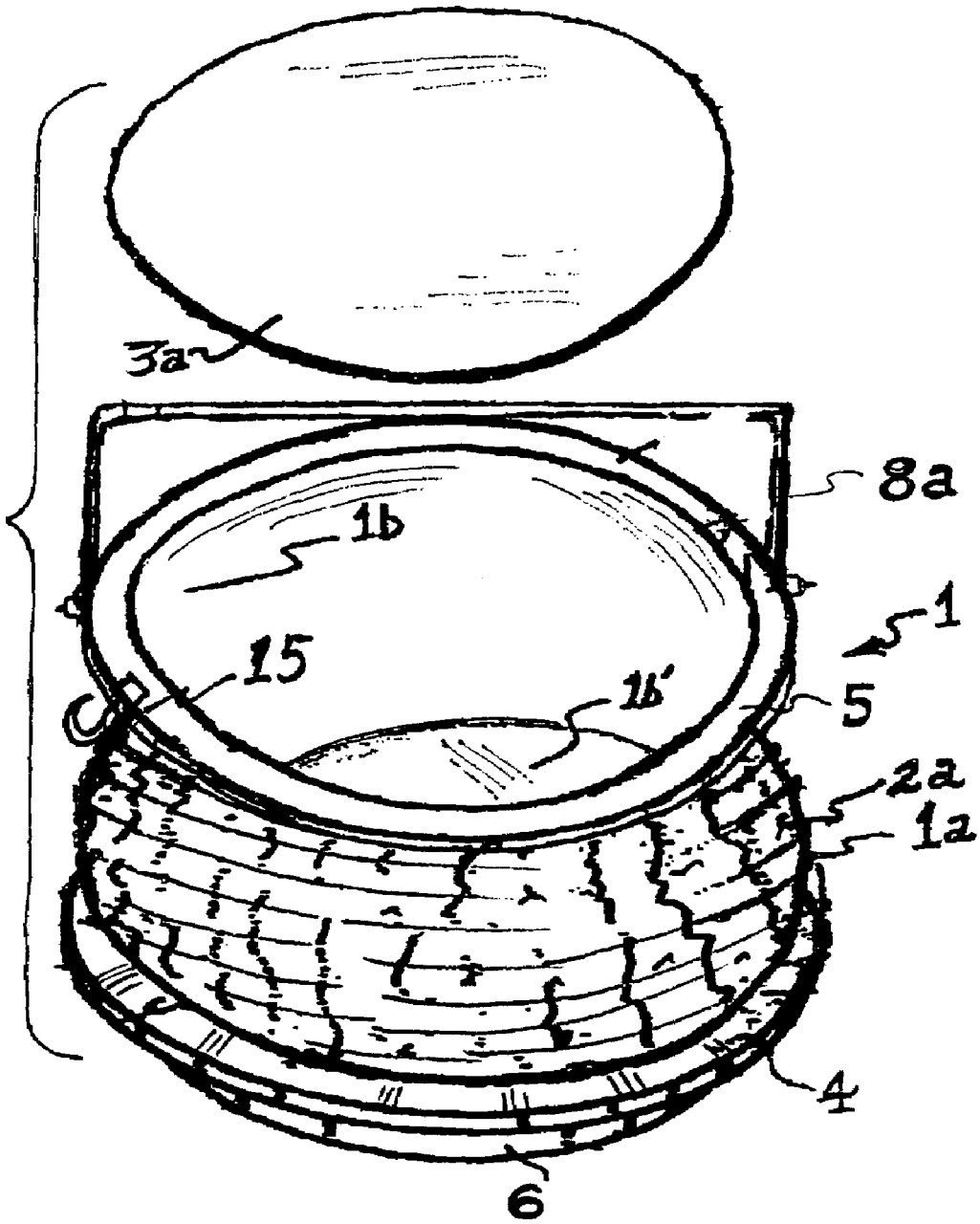
FIG. 14 illustrates, through yet another isometric view, an embodiment of said storage container having a bale, and a substantially flat lid configured to make a friction-fit, or snap-fit, at a top area of said container, said substantially flat lid is further structured for holding a user's weight when sitting or standing thereon.
Figure 16:
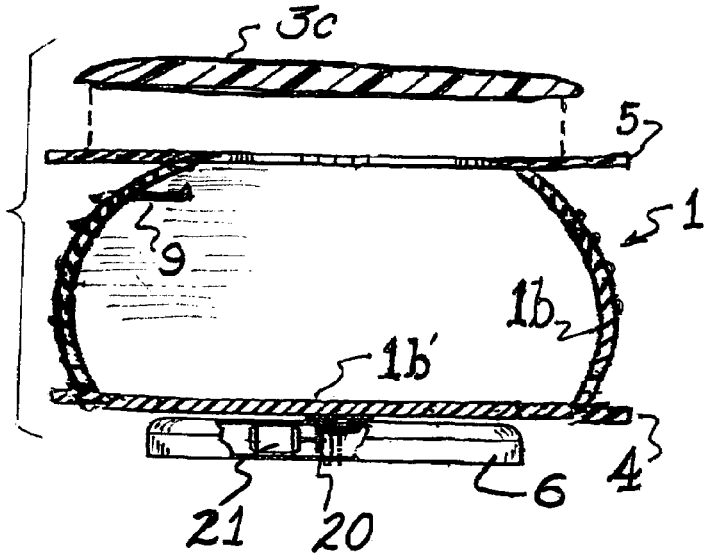
FIG. 16 is a further vertical cross-sectional view illustrating another form of flat, removable closure lid.

Shown in FIG. 14 is a configuration of storage container 1, wherein lid 3*a* is of a type and configuration to form a snap fit, or friction fit, with its corresponding housing opening at a top or uppermost area of said housing 1 adjacent to flange 5. Illustrated herein is a bale-type handle 8*a* configured and designed to fold flat or collapse against said housing 1. Exterior surface 1*a* is illustrated as having a textured surface, in addition to spiral grooves 2*a* to help retain elongated members stored temporarily on surface 1*a*. A simple modification of container lid 3*c* is illustrated in FIG. 16, and is shown to rest upon flange 5, rather than fit within the container opening 3*b*.

Figure 15:
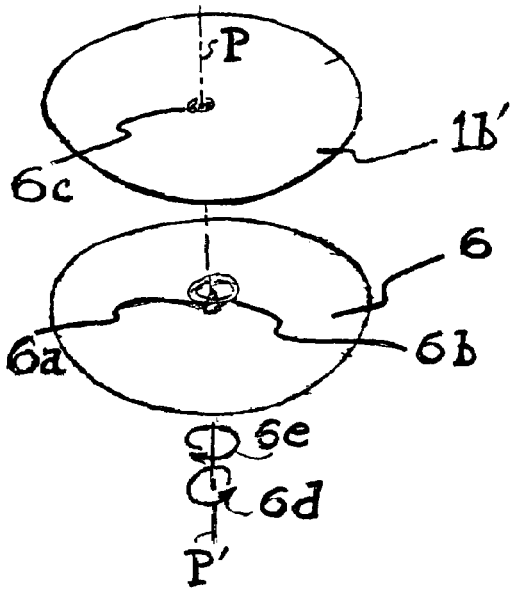
FIG. 15 shows an exploded view of component parts of the support base of said storage container, illustrating in particular a central pivot axis.

To permit free rotational motion of the storage container 1, as desired, FIG. 15 reveals details of an arrangement wherein container bottom surface 1*b*' is associated with a support base plate 6. Base plate 6 is furnished with a generally upstanding pivot pin 6*a*, adapted to extend through a matching hole 6*c* located at or very near a central portion of said container bottom surface 1*b*'.

A relatively small flange or bushing, or other well-known bearing element 6*b* is associated with support base plate 6 such that it supports said storage container bottom surface 1*b*' and thus permits it to rotate freely in a counter-clockwise direction 6*d* or clockwise direction 6*e*, as needed, around a pivot axis P–P'. Because of this arrangement, container housing 1 can be turned or rotated relative to stationary base plate 6 on its axis P–P' as desired. This facilitates winding or unwinding stored elongated members; it also allows for turning of said container housing when a user is seated or standing on a housing lid, for example lid 3*a*.

Alternatively, however, it may be desirable to provide a power drive for rotating the container housing 1, in a counter-clockwise or clockwise direction about the container's vertical axis. Shown in FIG. 16, and in varied detail in FIGS. 7, 8, 12, and 13, is a drive motor 21 generally confined within a stationary base plate 6, and configured to be drivingly interconnected to the bottom surface 1*b*' of storage container 1.

Any of a variety of driving arrangements may be constructed to enable said motor 21 to effect rotational movement on demand. For example, said motor output shaft may be fitted with an appropriate kinematics mechanism, e.g., a well-known 900 bevel-gear connection generally referred to as 20 interconnecting through a spline (not shown) which is positively linked to said bottom surface 1*b*'.

A further alternative mechanism is presented in FIG. 7A. Shown is a spring-driven retraction mechanism 6*f* housed within base plate 6, and windingly connected with post 6*a*. Said retraction mechanism is of the type typically found in an air hose automatic retraction device, or within typical canister vacuum-cleaner power-cord retraction unit. In the instant design, the spring-driven retraction mechanism is "loaded" through turning the storage housing 1 as by an uncoiling or unwrapping of a stored elongated member.

Upon reaching a fully or partially unwrapped or paid out condition, a temporary detent (not shown) holds, locks, retains or freezes said unwrapped condition, pending a brief jerking motion imparted manually by a user, thus releasing said detent. As said detent is released, said spring acts to transfer or return its stored energy by rotating said storage housing, which in turn re-wraps said elongated member about said storage container 1. This option can have special benefit, for example, in the embodiment exemplified in FIGS. 11 and 12, with respect to wrapping and unwrapping power cord 14.

Yet another additional feature of the instant invention includes the optional provision of rollers or casters shown generally in FIG. 7A at 41. Said rollers or casters 41 may be pivoted or otherwise folded against flange 4. Alternatively, said rollers may be mounted for linear or arcuate movement relative to said container 1. The purpose of said rollers or casters 41 is of course to provide ease of movement of said container. The rollers shown are mounted so as to be pivoted in to and out of service as desired and as is well known in the art. Also, as well known in the art, the rollers may be selectively locked to avoid inadvertent movement of the apparatus in use. Alternatively, wheels may be provided on each side of the storage container modeled after a wagon structure or on an axle on one side of the container modeled after a dolly structure, where heavier loads are anticipated.

In this regard, it is important to note that while a number of diverse features, arrangements and embodiments of the apparatus and method of the instant invention have been discussed and illustrated herein, the invention is by no means intended as being limited to such discrete or isolated descriptions. In other words, it should be readily apparent to those skilled in the art that embodiment features as described may be interrelated and combined to suit necessity.

For example, where a gardening application is discussed, it should be apparent that storage container features could include hooks, pockets, compartments as noted, and may further include the outer hood structure described with respect to another embodiment. Similarly, said gardening application might, or might not, include a rotational storage housing that is power driven; further, the housing outer surface might or might not include a power outlet unit.

There are of course a number of arrangements and applications for the method and apparatus described herein. For examples, such uses may include gardening, sewing and crocheting, animal grooming, electrical and handyperson work in/around the home or other workplace. The storage containers may be constructed of molded, light-weight, yet sturdy plastic. Alternatively, construction material could include certain metals and wood or even wicker-basket materials.

Also, there may be marketing advantages for the sale of such storage containers as complete kits or packages, already including sets of tools or implements, ornamental decorations, elongated cords such as extension cords or light wires and so on. Nothing in this disclosure is intended to limit the use or sale of the invention and method as including the novel container only, or in combination with pre-packed sets of tools or implements.

Upon careful reading of the foregoing specification and reviewing the drawings, it will be evident that this invention is susceptible of modification, combination, and alteration in a number of ways which may differ from those set forth. The particular arrangements disclosed are meant to be illustrative only and not limiting as to the scope of the invention which is to be given the full breadth of the claims appended hereto and any and all equivalents thereof. Accordingly, the following claims are intended to cover all such alterations and modifications which do not depart from the spirit and scope of the invention.

We claim:

1. Apparatus for storing articles including implements and associated elongated elements comprising:

a container having a side wall with an outer surface shaped to retain at least one elongated element wrapped around said outer surface;

said container side wall further defining an internal cavity adapted to contain implements;

said container further including spaced suspension members extended substantially radially inwardly within said cavity and adapted for suspending said implements;

a base having a substantially vertical pivot axis on which said container is mounted for rotation relative to said base about said substantially vertical pivot axis;

said outer surface is a surface of revolution about the substantially vertical pivot axis;

said container further including an opening at the top thereof providing access to the internal cavity, said opening closed by a movable lid that is substantially flat so as to serve as a weight-bearing support surface;

whereby said container simultaneously retains stored implements within the cavity defined by said inner surface, as well as stored elongated elements wrapped around said outer surface, and said support surface serves as a seat or step-stool.

2. The apparatus of claim 1 wherein said container includes compartments within said internal cavity below said suspension members;

both said compartments and suspension members are constructed to retain stored implements.

3. The apparatus of claim 1 wherein the container has a removable hood to enclose the side wall and stored elongated implements wrapped on the outer surface of said side wall.

4. The apparatus of claim 1 wherein said base is provided with support rollers.

5. The apparatus of claim 1 wherein the base has a powered device for rotating said container about the vertical axis, so as to facilitate wrapping and unwrapping of said elongated elements.

6. The apparatus of claim 1 wherein said outer surface curves upward and inward relative to said vertical axis.

7. The apparatus of claim 1 wherein said side wall includes an electric outlet unit having at least one female socket;

said electric outlet unit adapted to be electrically connected to a stored elongated element wrapped about said outer surface.

8. The apparatus of claim 1 wherein the suspension members are positioned at alternating staggered heights within the internal cavity.

9. The apparatus of claim 1 wherein the container has flexible compartments within the internal cavity;

said flexible compartments are adapted to store implements.

10. The apparatus of claim 9 wherein said flexible compartments comprise serially connected fabric pockets that are removable as a unit from said cavity;

whereby said pockets may be selectively removed from said container and adapted to serve as a work apron.

11. Apparatus for storing elongated elements and implements comprising a container having a side wall with an inner surface and an outer surface;

said outer surface adapted to retain stored elongated elements wrapped around said outer surface;

said inner surface structured to define an internal cavity shaped to contain stored implements;

the outer surface of said side wall is a surface of revolution and extends upward and inward;

the outer surface of the side wall includes a non-slip surface texture with a high coefficient of friction to resist downward sliding of wrapped elongated elements stored thereon;

said container is structured so as to define a top opening affording access to the internal cavity;

hangars positioned along the inner surface within the internal cavity and shaped to retain stored implements within the cavity.

12. The apparatus of claim 11 wherein said container is structured to define an opening at the top thereof providing access to the internal cavity;

a removable container lid closing said opening wherein said lid is substantially flat so as to serve as a weight-bearing support surface;

whereby said container, with its lid in place, can serve as a seat or step-stool.

13. The apparatus of claim 12 said lid further including a lock for securing it in a closed position.

14. The apparatus of claim 11 wherein the container has compartments in the internal cavity for retaining stored implements.

15. The apparatus of claim 11 wherein the outer surface of the side wall is a surface of revolution and curves upward and inward.

16. The apparatus of claim 11 wherein the outer surface of the side wall is a surface of revolution and slants upward and inward.

17. The apparatus of claim 11 wherein the non-slip surface texture of said outer surface further includes protuberances selected from the group consisting of ribs, buttons, segments and combinations thereof;

whereby said outer surface resists downward sliding of wrapped elongated elements stored thereon.

18. Apparatus for storing articles and elongated implements comprising a container having an upper end surface and a lower end surface and further having a side wall with an inner surface and an outer surface;

said outer surface having a roughened texture to retain said elongated elements thereon;

the roughened surface texture of said outer surface further includes protuberances selected from the group consisting of ribs, buttons, segments and combinations thereof;

said inner surface defining an internal cavity adapted to contain stored implements therein;

the outer surface of said side wall is a surface of revolution and slopes upward and inward from adjacent the lower end surface to the upper end surface of said container;

said container is structured so as to define at the upper end surface thereof a top opening affording access to the internal cavity;

hangars positioned along the inner surface within the internal cavity and adapted to retain stored implements within the cavity;

flexible, removable pockets positioned within said cavity adjacent said container lower end surface;

whereby said container may receive articles in the form of implements to be stored upon hangars or within removable pockets within the cavity thereof, and simultaneously said roughened surface texture and said protuberances serve to retain elongated elements on the outer surface thereof.

19. A method for simultaneously storing implements and associated elongated elements comprising the steps of:

providing a container with an inner cavity and an outer surface;

adapting said outer surface to retain at least one elongated element wrapped around said outer surface;

providing said cavity with spaced suspension members extended substantially radially inwardly within said cavity;

adapting said suspension members for suspending implements;

providing a base for said container wherein said base has a substantially vertical pivot axis;

adapting said container to rotate on said base about said vertical pivot axis;

forming said outer surface as a surface of revolution about said vertical pivot axis;

further providing access to said container by providing an opening at the top thereof closeable by a substantially flat lid;

adapting said lid to serve as a weight-bearing support;

storing implements within said container by placing them on said suspension members;

storing elongated elements on said outer surface by rotating said container about said vertical axis.

20. The method of claim 19, wherein said steps relate to the storage of gardening implements, and said at least one elongated element is a garden hose.

21. The method of claim 19 wherein said steps relate to carpentry, and said at least one elongated element is an electric cable.

22. The method of claim 21, further including the step of unwrapping said electric cable and connecting the container to a remote power supply source.

* * * * *